US006269960B1

(12) United States Patent
Harp

(10) Patent No.: US 6,269,960 B1
(45) Date of Patent: Aug. 7, 2001

(54) FELT TIP PEN HOLDER APPARATUS

(76) Inventor: Ronald D. Harp, 103 Wecks Rd., Myrtle Creek, OR (US) 97457

( * ) Notice: Subject to any disclaimer, the term of this patent is extended or adjusted under 35 U.S.C. 154(b) by 0 days.

(21) Appl. No.: 09/253,592

(22) Filed: Feb. 22, 1999

Related U.S. Application Data

(63) Continuation-in-part of application No. 07/631,071, filed on Dec. 20, 1990, now Pat. No. Des. 406,174.

(51) Int. Cl.[7] ..... A47F 7/00
(52) U.S. Cl. ..... 211/69.5
(58) Field of Search ..... D19/6; 211/69.5, 211/69.1, 60.1, 71.01, 70.6

(56) References Cited

U.S. PATENT DOCUMENTS

| | | | | |
|---|---|---|---|---|
| D. 265,324 | | 7/1982 | Hedgeman . | |
| D. 290,853 | * | 7/1987 | Appel | 211/69.5 |
| D. 298,639 | | 11/1988 | Wolff . | |
| D. 304,038 | | 10/1989 | Janson . | |
| D. 395,777 | * | 7/1998 | Belokin | 211/69.5 |
| 4,121,719 | | 10/1978 | Wilhelm . | |
| 4,736,853 | * | 4/1988 | O'Mara | 211/69.1 |
| 5,025,934 | * | 6/1991 | Vogel | 211/69.5 |
| 5,842,584 | * | 12/1998 | Baird | 211/69.1 |

* cited by examiner

*Primary Examiner*—Alvin Chin-Shue
*Assistant Examiner*—Sarah Purol

(57) ABSTRACT

A writing implement holder apparatus includes a flexible planar base which includes a top base end and a bottom base end. A plurality of writing implement receivers are attached to the bottom base end, wherein each of the writing implement receivers includes a longitudinal axis which is parallel to the base. A flexible flap is connected to the top base end. A first lock member is connected to the flap, and a second lock member is connected to the base. The first lock member is a snap, and the second lock member is a snap receiver. The writing implement is a felt tip marker. With a second embodiment of the invention, a first base attachment connector is connected to a front base surface at a first base side end, and a second base attachment connector is connected to a rear base surface at a second base side end. The first base attachment connector is a first hook-and-loop connector, and the second base attachment connector is a second hoop-and-loop connector. When the first hook-and-loop connector and the second hoop-and-loop connector are connected together, the second embodiment of the invention stands vertically on a horizontal surface. Each of the writing implement receivers includes an implement reception well which is complimentary to a tip portion of a writing implement.

7 Claims, 10 Drawing Sheets

FELT TIP PEN HOLDER APPARATUS

CROSS-REFERENCE TO RELATED APPLICATION

This application is a continuation-in-part of my co-pending prior application Ser. No. 07/631,071, filed Dec. 20, 1990, now U.S. Pat. No. Des. 406,174.

BACKGROUND OF THE INVENTION

1. Field of the Invention

The present invention relates generally to holders for writing implements, and, more particularly, to writing implement holders especially adapted for holding felt tip markers and pens.

2. Description of the Prior Art

Felt tip markers and pens are well known in the art of writing implements. To prevent premature drying out of the marker or pen, a cap which forms a substantially air tight seal is generally placed on the marker or pen. Often, however, the cap is misplaced or lost, and the marker or pen will dry out prematurely. In this respect, it would be desirable if a device were provided that prevents loss of a cap for a marker or pen.

Throughout the years, a number of innovations have been developed relating to holders for writing implements, and the following U.S. patents are representative of some of those innovations: U.S. Pat. Nos. Des. 265,324, Des. 290, 853, Des. 298,639, Des. 304,038, and 4,121,719. More specifically, U.S. Pat. No. Des. 265,324 discloses a design for a felt pen holder which has a flat base that is attachable to a vertical planar surface. This felt pen holder is not free-standing, but must be attached to a vertical surface to function as designed. Markers and pens are often carried from one location to another, especially by children, and in this respect, it would be desirable if a felt tip marker holder were provided which is portable.

U.S. Pat. No. Des. 290,853 discloses a design for a crayon holder which discloses a plurality of crayon receivers arrayed in a circular array around a central cylinder. Crayons do not contain volatile liquids that must be prevented from evaporation. In this respect, the crayon receivers do not provide air tight seals with the crayons. Moreover, the circular array of crayon receivers is formed as a rigid closed circle. In this respect, for storage or transport, the circular array cannot be released to form a flat array of crayon receivers. For ease in transport, it would be desirable if a circular array of writing implement receivers could be flattened.

U.S. Pat. No. Des. 298,639 discloses a design for a holder for pens, pencils, and the like. The holder is portable, but it does not form substantially air tight seals between the writing implements and the holder. In this respect, it would be desirable if a felt tip marker holder apparatus were provided which is portable and forms substantially air tight seals between the writing implements and the holder.

U.S. Pat. No. Des. 304,038 discloses a design for a desk set that receives a pair of writing implements that are spaced apart from one another by a substantial distance on a rigid base member that has pointed corners. Felt tip markers often come in sets having a relatively large number of colors. Therefore, a holder should have a relatively large number of marker receivers to receive a large set of markers. Moreover, for the safety of children, rather than having a rigid base with pointed corners, it would desirable if a felt tip marker holder apparatus had a flexible base which does not have pointed corners.

U.S. Pat. No. 4,121,719 discloses a holder for writing instruments that is in a form of a rigid pyramid or pyramid-like structure. As such, the holder cannot be flattened for ease in transport and storage. Moreover, each individual writing instrument receiver has two open ends and does not form an air tight seal with the individual writing instruments. In this respect, it would be desirable if a receiver for a writing implement had only one open end for receiving the writing implement so that an air tight seal can be formed between the receiver and the writing implement.

Still other features would be desirable in a felt tip marker holder apparatus. For example, so that different colors do not intermingle between markers and marker receivers, it would be desirable if the marker receivers were color coded to correspond to the colors of the markers which are to be received.

Furthermore, if the holder is dropped, it would be desirable if a cover flap were provided to prevent markers from falling out from the holder. In this respect, it would be desirable if a snap or other lock were provided to keep the flap closed when the flap is being used.

At times it may be desirable if the felt tip marker holder apparatus were used in a flat orientation, such as when laying flat on a horizontal surface. At other times it may be desirable if the felt tip marker holder apparatus were formed into cylindrical orientation and stood up on a horizontal surface. To provide for both results, it would be desirable if a felt tip marker holder apparatus were easily convertible between a holder which lays flat on a horizontal surface and a holder which stands vertically on a horizontal surface.

Thus, while the foregoing body of prior art indicates it to be well known to use holders for writing implements, the prior art described above does not teach or suggest a felt tip marker holder apparatus which has the following combination of desirable features: (1) prevents loss of a cap for a marker or pen; (2) is portable; (3) forms substantially air tight seals between the writing implements and the holder; (4) has a relatively large number of marker receivers for receiving a large set of markers; (5) has a flexible base which does not have pointed corners; (6) has a circular array of writing implement receivers which can be flattened; (7) has marker receivers which have only one open end for receiving the markers so that an air tight seal can be formed between the receiver and each marker; (8) has marker receivers which are color coded to correspond to the colors of the markers which are to be received; (9) has a cover flap to prevent markers from falling out from the holder if the holder is dropped; (10) has a snap or other lock to keep the flap closed when the flap is being used; and (11) is easily convertible between a holder which lays flat on a horizontal surface and a holder which stands vertically on a horizontal surface.

The foregoing desired characteristics are provided by the unique felt tip marker holder apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a writing implement holder apparatus which includes a flexible planar base which includes a top base end and a bottom base end. A plurality of writing implement receivers are attached to the bottom base end, wherein each of the writing implement receivers includes a longitudinal axis which is parallel to the base. A flexible flap is connected to the top base end. The base and the flap are a unified, integrated structure.

A first lock member is connected to the flap, and a second lock member is connected to the base. The first lock member is a snap, and the second lock member is a snap receiver. The writing implement is a felt tip marker.

The base includes a front base surface and a rear base surface, and the base includes a first base side end and a second base side end, the writing implement receivers are attached to the front base surface.

With a second embodiment of the invention, a first base attachment connector is connected to the front base surface at the first base side end, and a second base attachment connector is connected to the rear base surface at the second base side end. The first base attachment connector is a first hook-and-loop connector, and the second base attachment connector is a second hoop-and-loop connector. When the first hook-and-loop connector and the second hoop-and-loop connector are connected together, the second embodiment of the invention stands vertically on a horizontal surface.

Each of the writing implement receivers includes an implement reception well which is complimentary to a tip portion of a writing implement.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved felt tip marker holder apparatus which has all of the advantages of the prior art and none of the disadvantages.

It is another object of the present invention to provide a new and improved felt tip marker holder apparatus which may be easily and efficiently manufactured and marketed.

It is a further object of the present invention to provide a new and improved felt tip marker holder apparatus which is of durable and reliable construction.

An even further object of the present invention is to provide a new and improved felt tip marker holder apparatus which is susceptible of a low cost of manufacture with regard to both materials and labor, and which accordingly is then susceptible of low prices of sale to the consuming public, thereby making such felt tip marker holder apparatus available to the buying public.

Still yet a further object of the present invention is to provide a new and improved felt tip marker holder apparatus which prevents loss of a cap for a marker or pen.

Still another object of the present invention is to provide a new and improved felt tip marker holder apparatus that is portable.

Yet another object of the present invention is to provide a new and improved felt tip marker holder apparatus which forms substantially air tight seals between the markers and the holder.

Even another object of the present invention is to provide a new and improved felt tip marker holder apparatus that has a relatively large number of marker receivers for receiving a large set of markers.

Still a further object of the present invention is to provide a new and improved felt tip marker holder apparatus which has a flexible base which does not have pointed corners.

Yet another object of the present invention is to provide a new and improved felt tip marker holder apparatus that has a circular array of writing implement receivers which can be flattened.

Still another object of the present invention is to provide a new and improved felt tip marker holder apparatus which has marker receivers which have only one open end for receiving the markers so that an air tight seal can be formed between the receiver and each marker.

Yet another object of the present invention is to provide a new and improved felt tip marker holder apparatus that has marker receivers which are color coded to correspond to the colors of the markers which are to be received.

Still a further object of the present invention is to provide a new and improved felt tip marker holder apparatus that has a cover flap to prevent markers from falling out from the holder if the holder is dropped.

Yet another object of the present invention is to provide a new and improved felt tip marker holder apparatus which has a snap or other lock to keep the flap closed when the flap is being used.

Still a further object of the present invention is to provide a new and improved felt tip marker holder apparatus that is easily convertible between a holder which lays flat on a horizontal surface and a holder which stands vertically on a horizontal surface.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof Such description makes reference to the annexed drawing wherein.

DESCRIPTION OF THE PREFERRED EMBODIMENT

Figure 1:
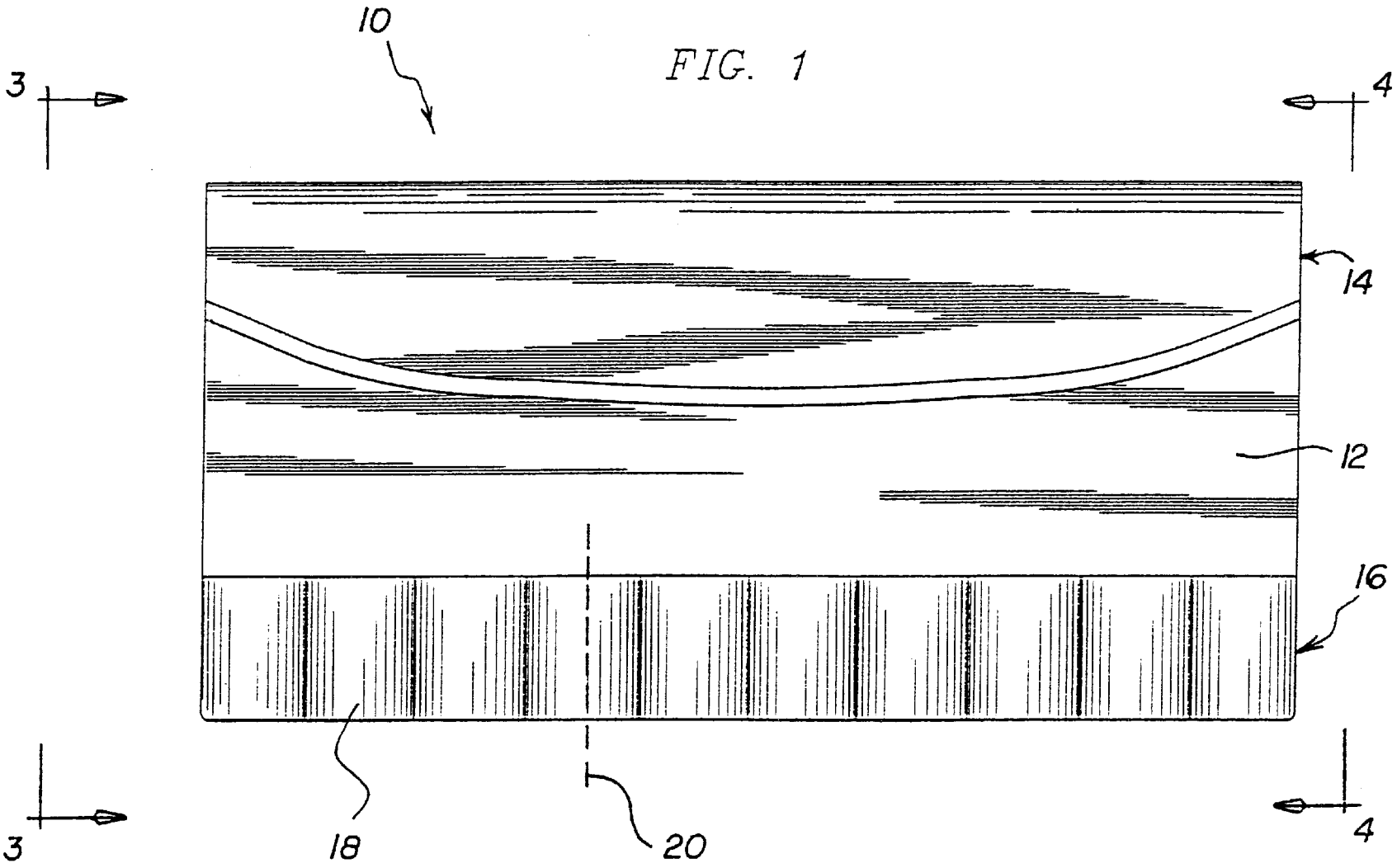
FIG. 1 is a front view of a first embodiment of the felt tip marker holder apparatus of the invention.
Figure 2:
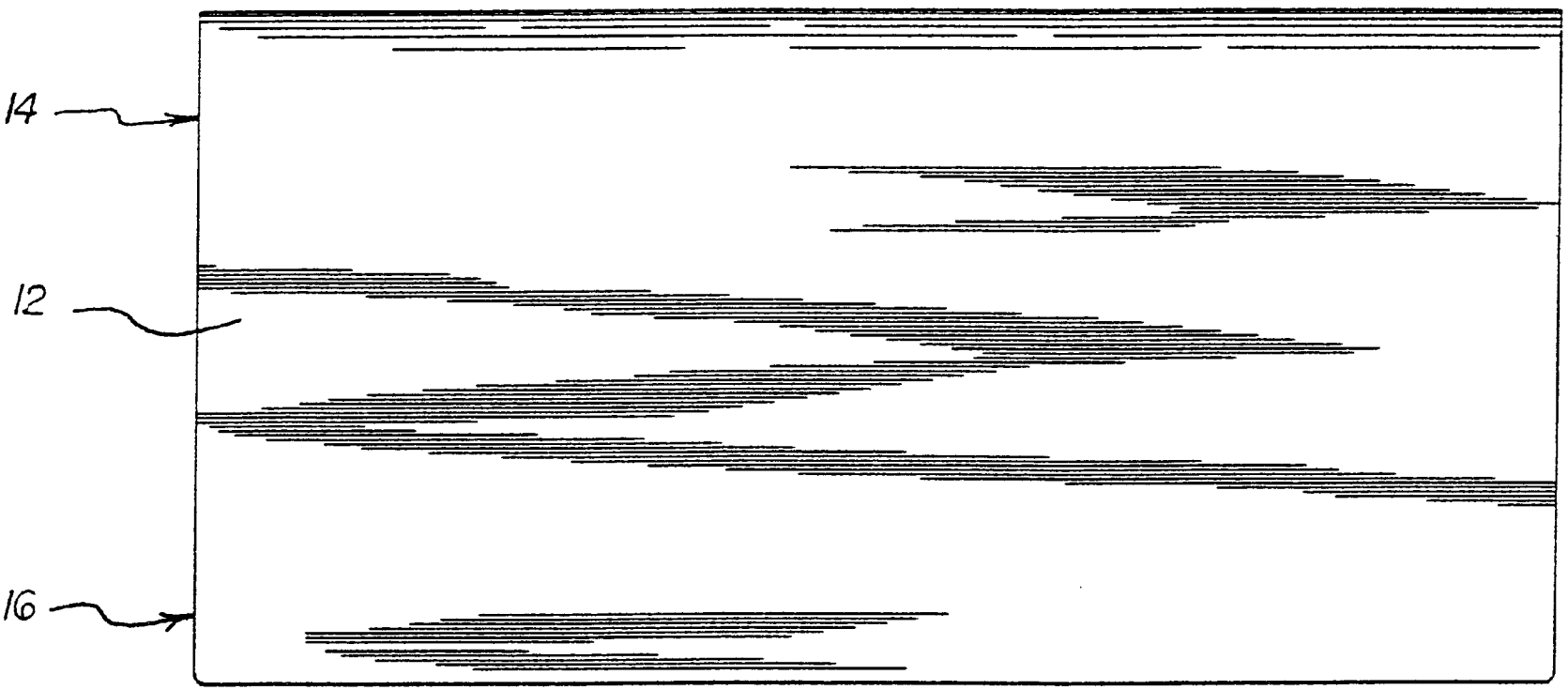
FIG. 2 is a rear view of the embodiment of the invention shown in FIG. 1
Figure 3:
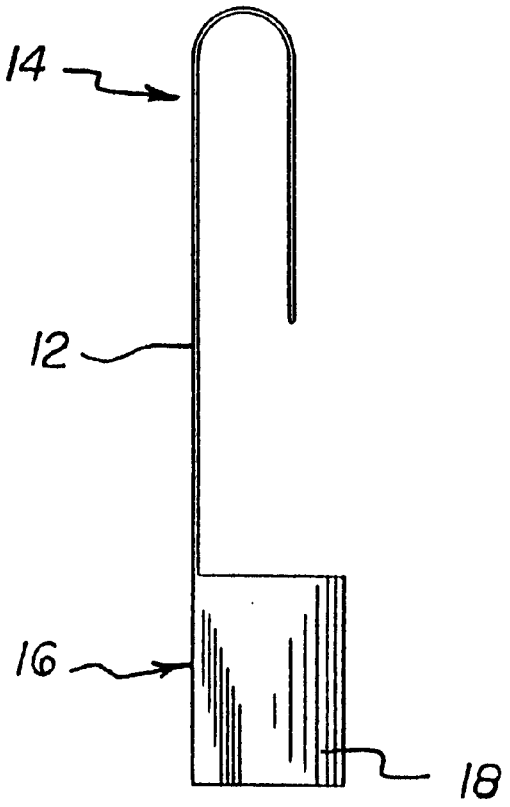
FIG. 3 is a side view of the embodiment of the felt tip marker holder apparatus of FIG. 1 taken along line 3—3 thereof.
Figure 4:
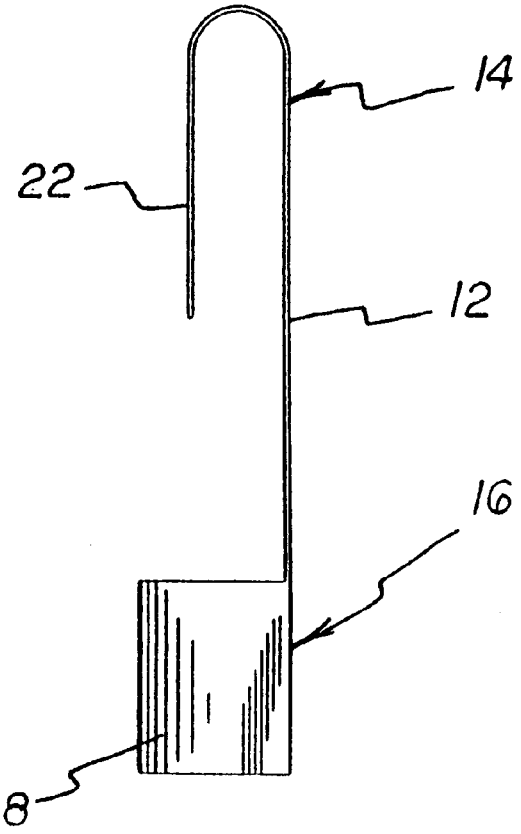
FIG. 4 is a side view of the embodiment of the felt tip marker holder apparatus of FIG. 1 taken along line 4—4 thereof.
Figure 5:
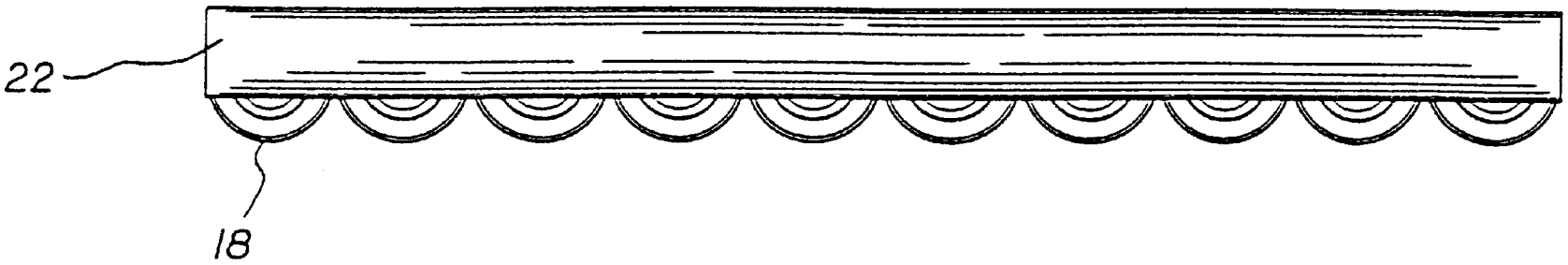
FIG. 5 is a top view of the embodiment of the invention shown in FIG. 1.
Figure 6:
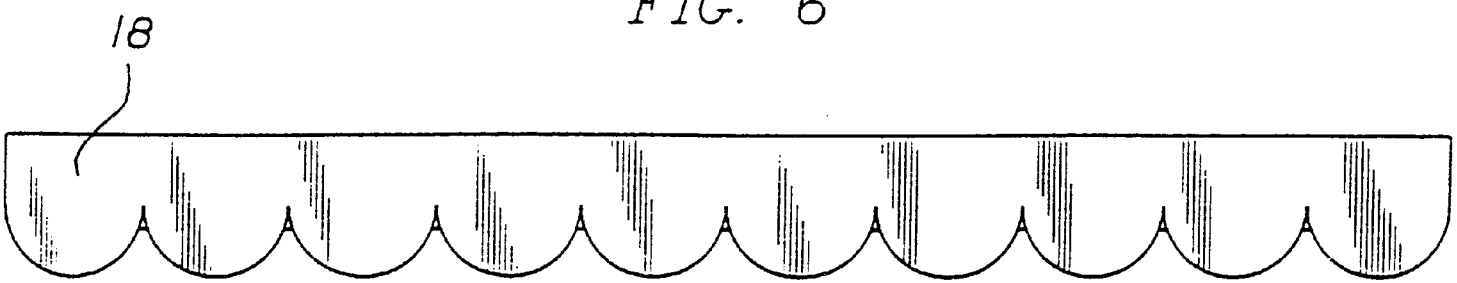
FIG. 6 is a bottom view of the embodiment of the invention shown in FIG. 1.

With reference to the drawings, a new and improved felt tip pen holder apparatus embodying the principles and concepts of the present invention will be described.

Turning to FIGS. 1–7, there is shown a first embodiment of the felt tip pen holder apparatus of the invention generally designated by reference numeral 10. The felt tip pen holder apparatus 10 includes a flexible planar base 12 which includes a top base end 14 and a bottom base end 16. A plurality of writing implement receivers 18 are attached to the bottom base end 16, wherein each of the writing implement receivers 18 includes a longitudinal axis 20 which is parallel to the base 12. A flexible flap 22 is connected to the top base end 14. The base 12 and the flap 22 are a unified, integrated structure.

Figure 7:
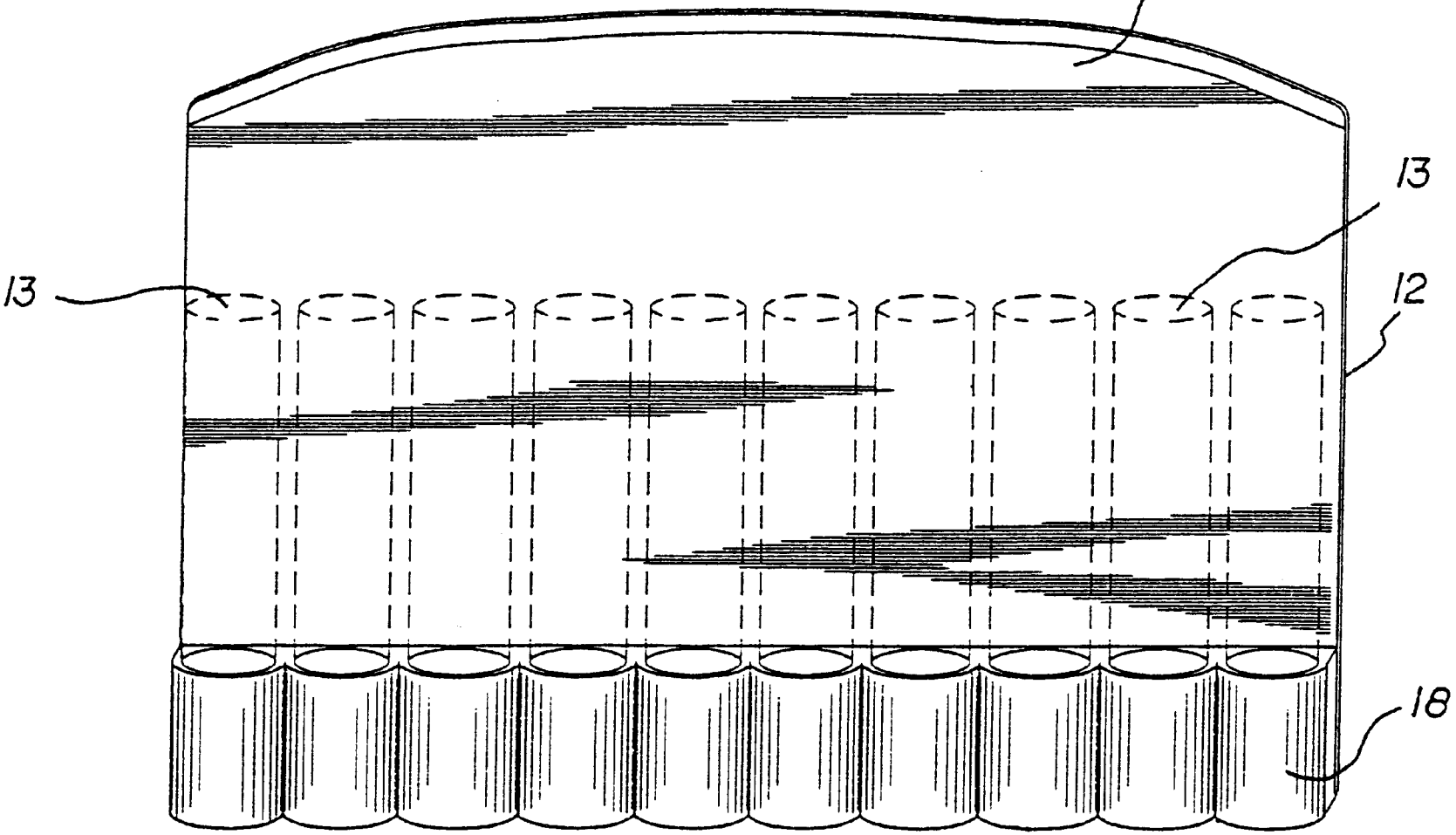
FIG. 7 is a front view of the embodiment of the invention shown in FIG. 1 with felt tip markers being retained by the holder and with a cover flap in an upwardly extended orientation.
Figure 8:
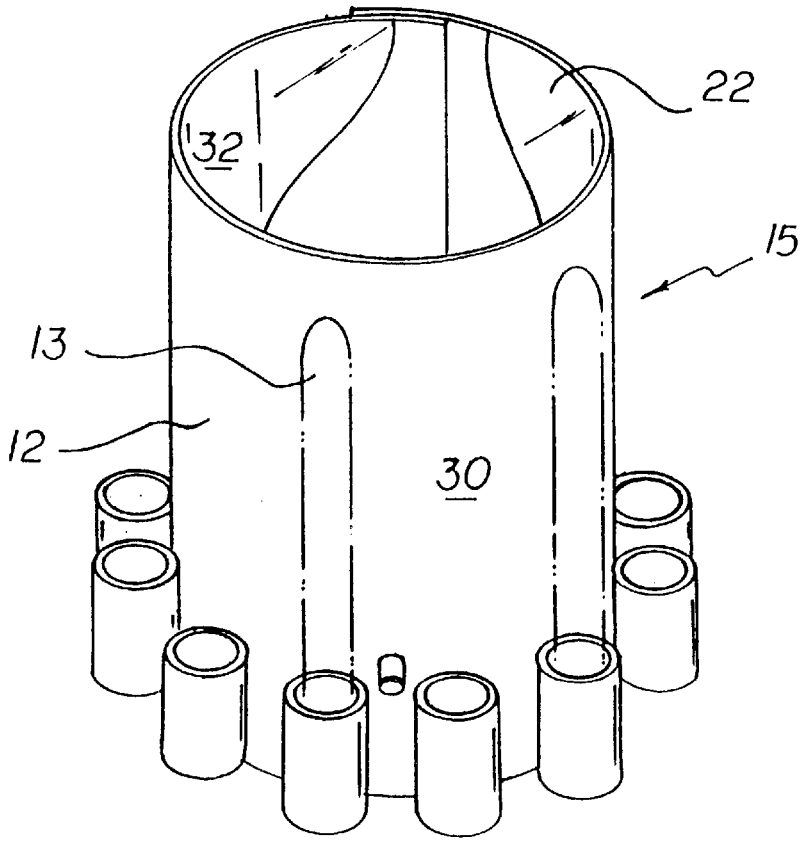
FIG. 8 is a perspective view of a second embodiment of the felt tip marker holder apparatus of the invention, wherein the embodiment is in a closed orientation.
Figure 9:
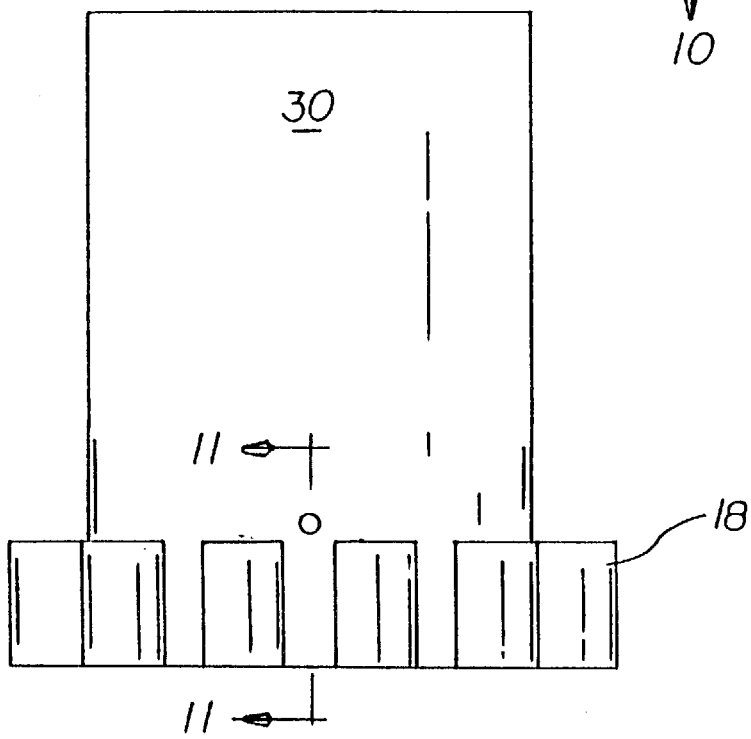
FIG. 9 is a front view of the embodiment of the invention shown in FIG. 8.
Figure 10:
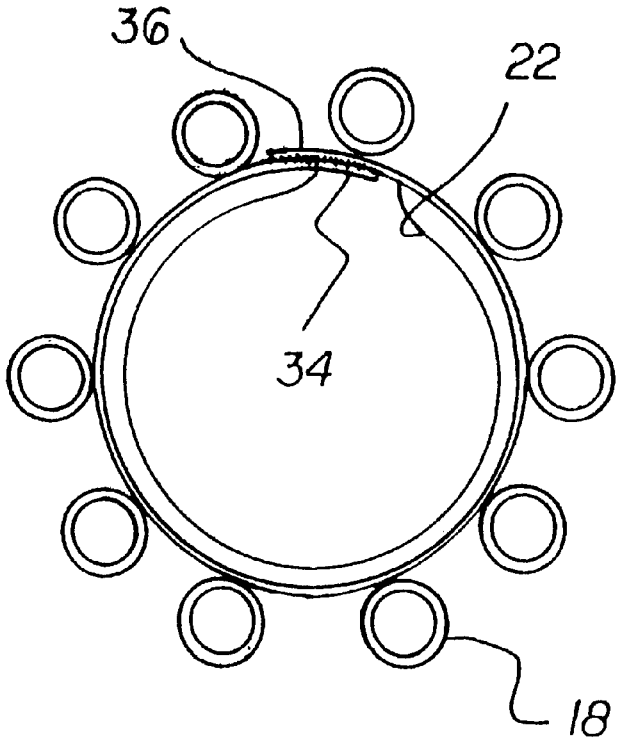
FIG. 10 is a top view of the embodiment of the invention shown in FIG. 9 taken along line 10—10 thereof.

To use the first embodiment of the invention, shown in FIGS. 1–7, the tip portions of the felt tip markers 13 are placed in the writing implement receivers 18 so that the tip portions form a substantially air tight seal with the writing implement receivers 18. As shown in FIGS. 1–7, the flap 22 can be is a downward orientation so that the flap 22 covers the top end portions of the felt tip markers 13. This orientation of the flap 22 prevents the felt tip markers 13 from falling out from the writing implement holder apparatus 10. As shown in FIG. 7, the flap 22 can be in an upward orientation, whereby the felt tip markers 13 are easily taken out from and placed back into the writing implement receivers 18.

In accordance with the second embodiment of the invention 15 shown in FIGS. 8–15, the base 12 includes a front base surface 30 and a rear base surface 32, and the base 12 includes a first base side end 34 and a second base side end 36, the writing implement receivers 18 are attached to the front base surface 30.

A first base attachment connector 38 is connected to the front base surface 30 at the first base side end 34, and a second base attachment connector 40 is connected to the rear base surface 32 at the second base side end 36. The first base attachment connector 38 is a first hook-and-loop connector 38, and the second base attachment connector 40 is a second hoop-and-loop connector 40. The first hook-and-loop connector 38 and the second hoop-and-loop connector 40 are made from well known VELCRO(TM) material.

Figure 11:
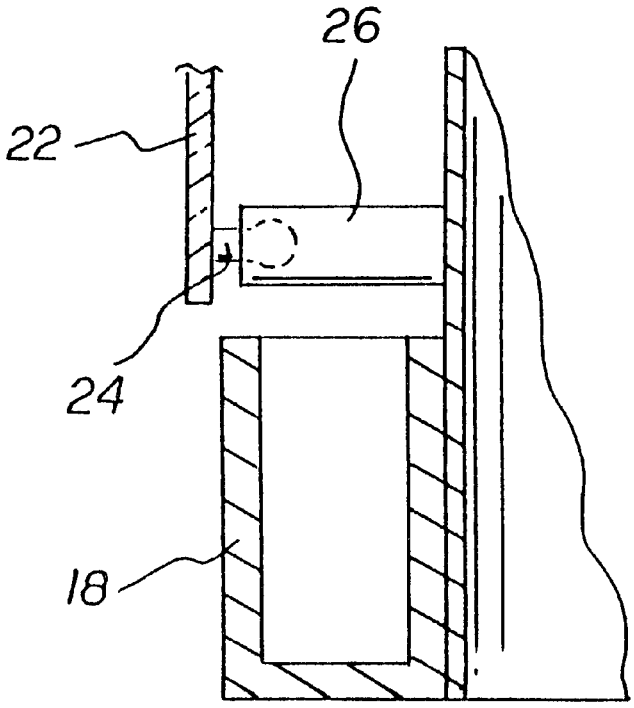
FIG. 11 is an enlarged cross-sectional view of the portion of the embodiment of the invention shown in FIG. 13 taken along line 11—11 thereof.
Figure 12:
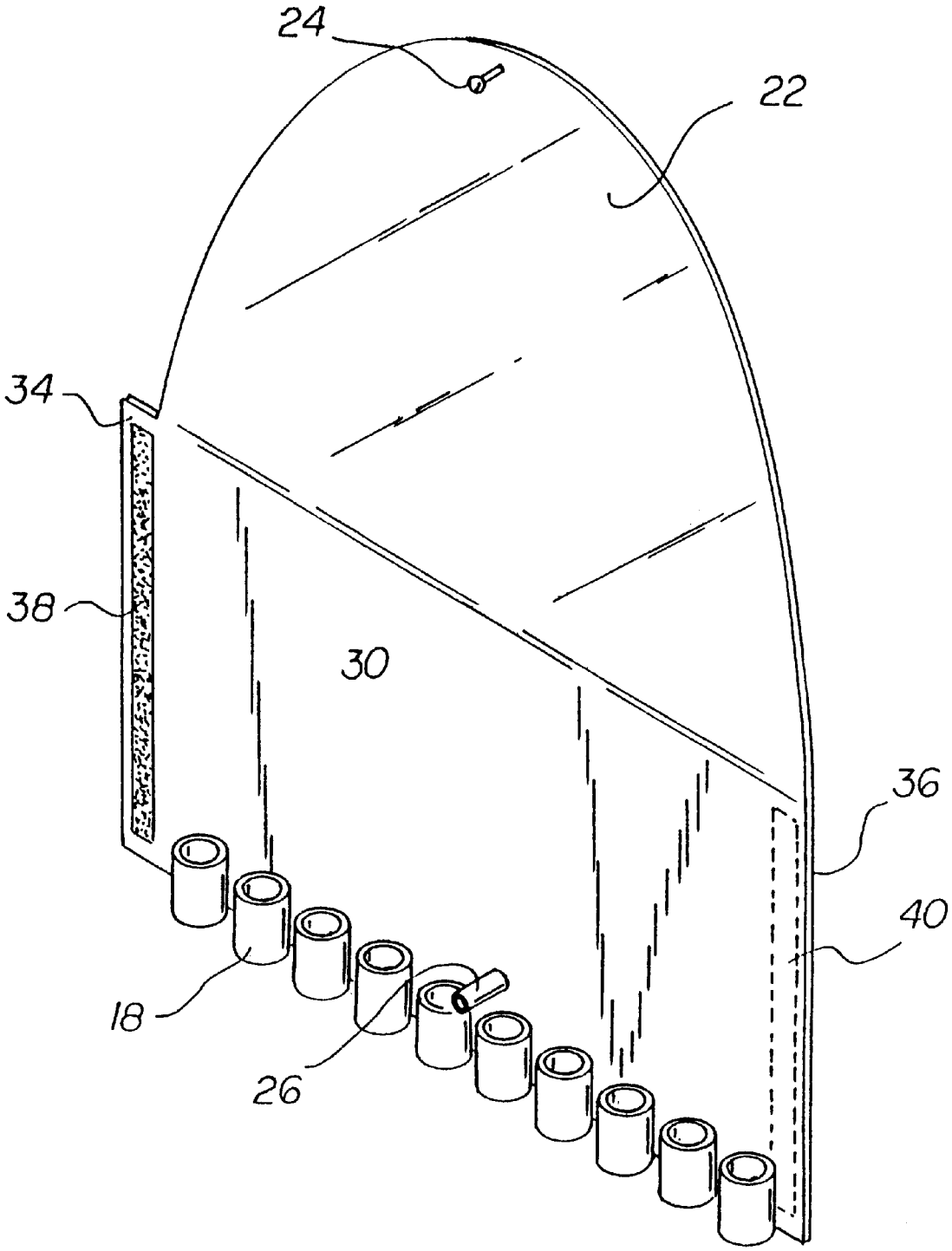
FIG. 12 is a perspective view of the embodiment of the invention shown in FIG. 8, wherein the embodiment is in an open orientation with a cover flap unlocked and extending upwardly.
Figure 13:
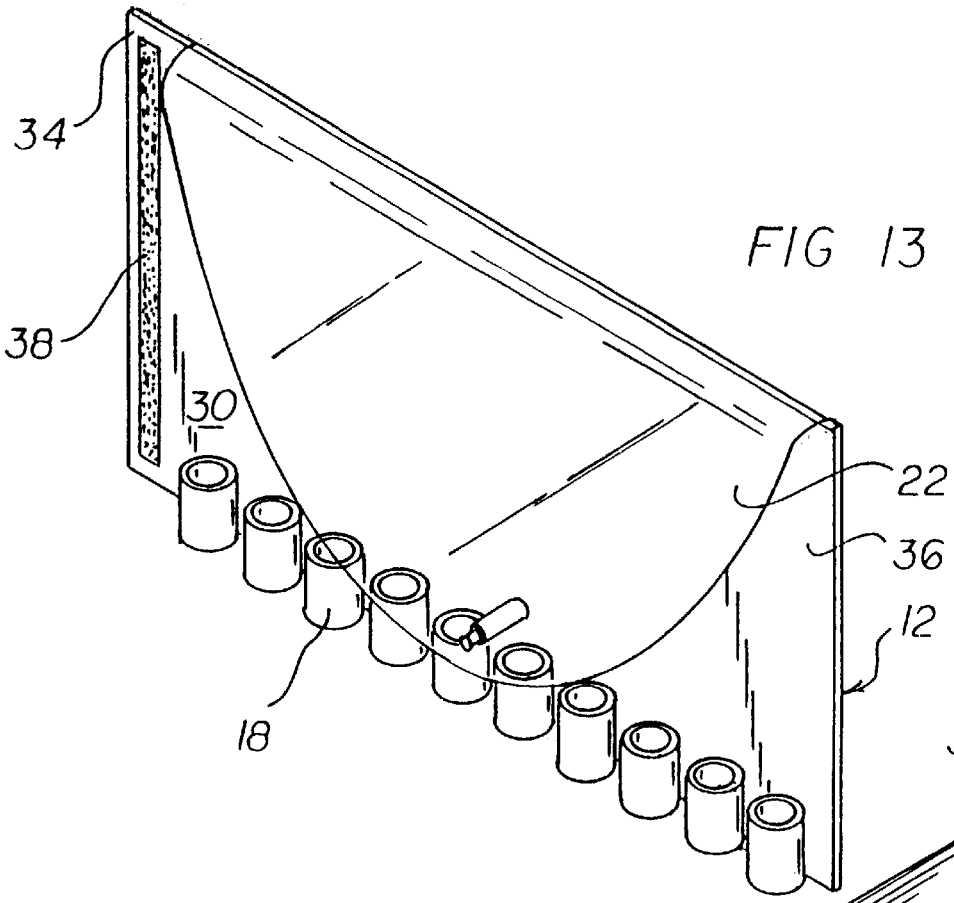
FIG. 13 is a perspective view of the embodiment of the invention shown in FIG. 12, wherein the embodiment is in an open orientation with the cover flap extending downward in front of the apparatus and is locked.

As best shown in FIGS. 11–13, a first lock member 24 is connected to the flap 22, and a second lock member 26 is connected to the base 12. The first lock member 24 is a snap 24 and The second lock member 26 is a snap receiver 26. The writing implement is a felt tip marker 13.

Each of the writing implement receivers 18 includes an implement reception well 42 which is complimentary to a tip portion 44 of a writing implement.

The second embodiment of the invention 15 can be used in three different orientations. The first orientation is shown in FIG. 13 in which the flap 22 is down and locked with the first lock member 24 in engagement with the second lock member 26. In this orientation, felt tip markers 13 can be secured to the second embodiment of the invention 15.

The second orientation is shown in FIG. 12 and is analogous to FIG. 7 for the first embodiment. That is, the flap 22 is unlocked and is in an upward orientation to permit removal of felt tip markers 13 from the writing implement receivers 18 and to permit felt tip markers 13 to be placed back in the writing implement receivers 18.

Figure 14:
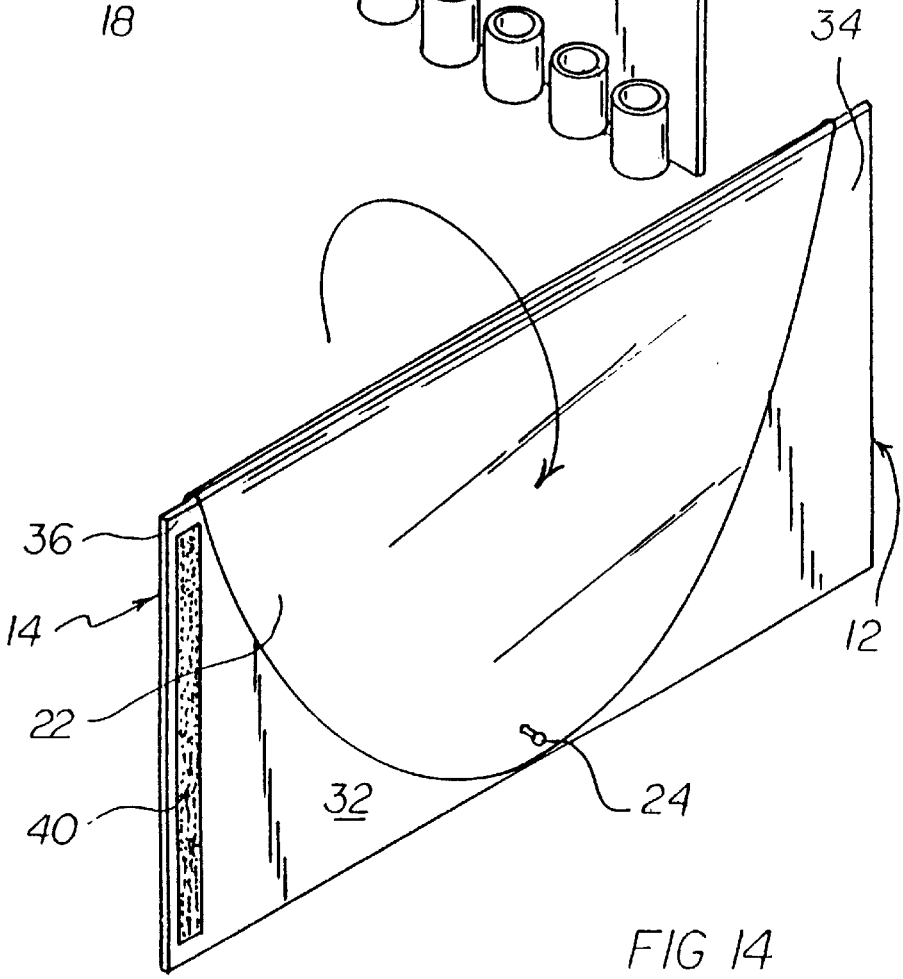
FIG. 14 is a perspective view of the embodiment of the invention shown in FIG. 13, wherein the embodiment is in an open orientation with the cover flap extending downward in back of the apparatus and is unlocked.
Figure 15:
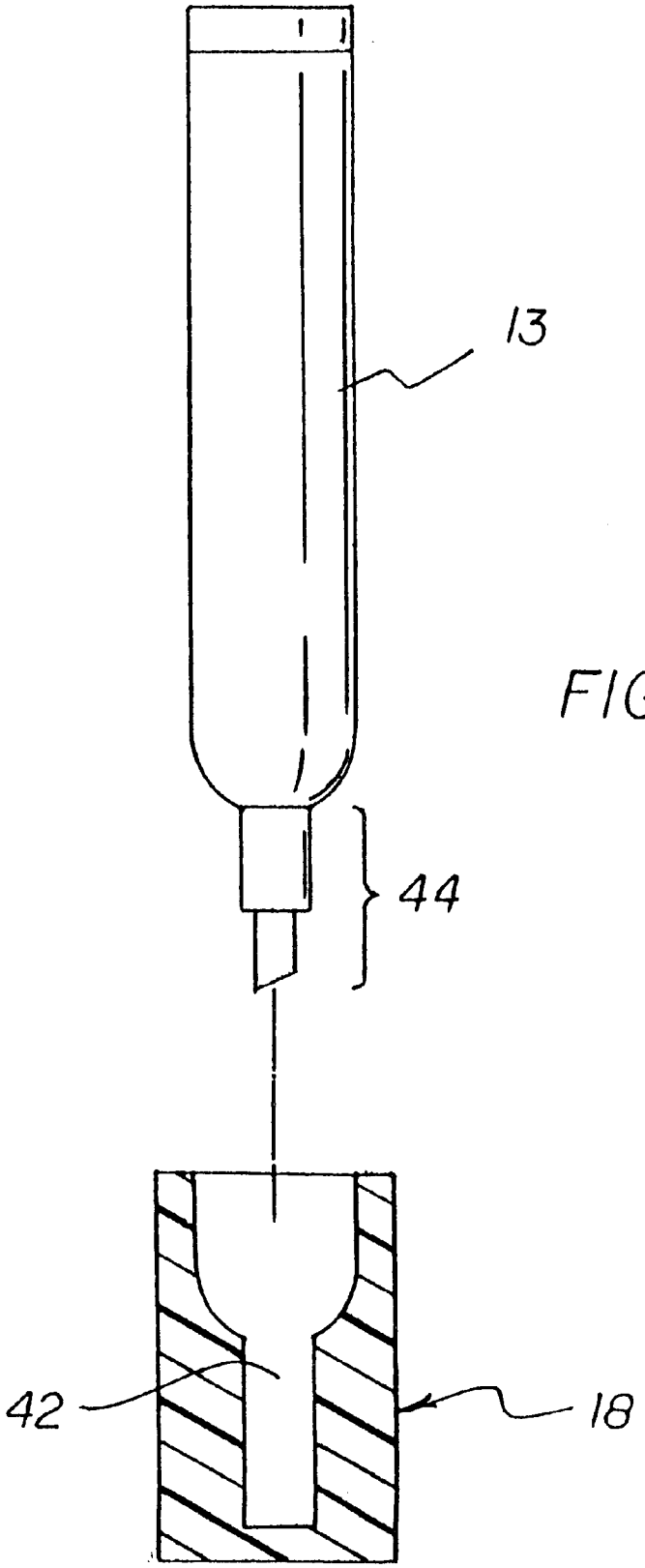
FIG. 15 is an exploded view of a felt tip pen that fits into a complimentarily shaped felt tip pen holder element.

The third orientation of the second embodiment of the invention 15 is shown in FIGS. 8–11. With the third orientation, the flap 22 is rotated around the top base end 14 so that the flap 22 rests against the rear base surface 32 as shown in FIG. 14. Then, the second base side end 36 is pulled around to the first base side end 34 so that the first hook-and-loop connector 38 is placed in connection with the second hoop-and-loop connector 40. When this has been done, the third orientation of the invention is obtained. In the third orientation, the second embodiment of the invention 15 stands vertically on a horizontal surface. In this orientation, the flap 22 is folded back inside a cylinder formed by the upstanding second embodiment of the invention 15.

The components of the felt tip pen holder apparatus of the invention can be made from inexpensive and durable plastic and metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved felt tip pen holder apparatus that is low in cost, relatively simple in design and operation, and which may advantageously be used to prevent loss of a cap for a marker or pen. With the invention, a felt tip marker holder apparatus is provided which is portable. With the invention, a felt tip marker holder apparatus is provided which forms substantially air tight seals between the markers and the holder. With the invention, a felt tip marker holder apparatus is provided which has a relatively large number of marker receivers for receiving a large set of markers. With the invention, a felt tip marker holder apparatus is provided which has a flexible base which does not have pointed corners. With the invention, a felt tip marker holder apparatus is provided which has a circular array of writing implement receivers which can be flattened.

With the invention, a felt tip marker holder apparatus is provided which has marker receivers which have only one open end for receiving the markers so that an air tight seal can be formed between the receiver and each marker. With the invention, a felt tip marker holder apparatus is provided which has marker receivers which are color coded to correspond to the colors of the markers which are to be received. With the invention, a felt tip marker holder apparatus is provided which has a cover flap to prevent markers from falling out from the holder if the holder is dropped. With the invention, a felt tip marker holder apparatus is provided which has a snap or other lock to keep the flap closed when the flap is being used. With the invention, a felt tip marker holder apparatus is provided which is easily convertible between a holder which lays flat on a horizontal surface and a holder which stands vertically on a horizontal surface.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A holder apparatus for writing implements comprising: in combination a plurality of writing implements, a flexible planar base which includes a top base end and a bottom base end, and a plurality of writing implement receivers attached to said bottom base end, wherein each of said writing implement receivers includes a longitudinal axis which is parallel to said bases, wherein:

said base includes a front base surface and a rear base surface, and wherein said base includes a first base side end and a second base side end, and said writing implement receivers are attached to said front base surface, further including:

a first base attachment connector connected to said front base surface at said first base side end, and a second base attachment connector connected to said rear base surface at said second base side end.

2. The apparatus of claim 1, further including:

a flexible flap connected to said top base end.

3. The apparatus of claim 2 wherein said base and said flap are a unified, integrated structure.

4. The apparatus of claim 2, further including:

a first lock member connected to said flap, and a second lock member connected to said base.

5. The apparatus of claim 4 wherein said first lock member is a snap and wherein said second lock member is a snap receiver.

6. The apparatus of claim 1 wherein:

said first base attachment connector is a first hook-and-loop connector, and said second base attachment connector is a second hoop-and-loop connector.

7. The apparatus of claim 1 wherein each of said writing implement receivers includes an implement reception well which is complementary to a tip portion of a writing implement.

* * * * *